US009490083B2

(12) United States Patent
Connell

(10) Patent No.: US 9,490,083 B2
(45) Date of Patent: Nov. 8, 2016

(54) ALTERNATING CURRENT SWITCH CONTACTOR

(71) Applicant: Johnson Electric S.A., Murten (CH)

(72) Inventor: Richard Anthony Connell, Cambridge (GB)

(73) Assignee: Johnson Electric S.A., Murten (CH)

( * ) Notice: Subject to any disclaimer, the term of this patent is extended or adjusted under 35 U.S.C. 154(b) by 1 day.

(21) Appl. No.: 14/554,440

(22) Filed: Nov. 26, 2014

(65) Prior Publication Data

US 2015/0145621 A1 May 28, 2015

(30) Foreign Application Priority Data

Nov. 26, 2013 (GB) ..... 1320859.0

(51) Int. Cl.

| | |
|---|---|
| ***H01H 51/22*** | (2006.01) |
| ***H01H 7/16*** | (2006.01) |
| ***H01H 47/22*** | (2006.01) |
| ***H01H 50/44*** | (2006.01) |
| ***H01H 1/50*** | (2006.01) |
| ***H01H 9/30*** | (2006.01) |
| ***H01H 3/28*** | (2006.01) |
| ***H01H 9/56*** | (2006.01) |
| ***H01H 47/02*** | (2006.01) |
| ***H01H 1/54*** | (2006.01) |
| *H01H 50/24* | (2006.01) |
| *H01H 50/54* | (2006.01) |

(52) U.S. Cl.

CPC ..... *H01H 7/16* (2013.01); *H01H 1/50* (2013.01); *H01H 1/54* (2013.01); *H01H 3/28* (2013.01); *H01H 9/30* (2013.01); *H01H 9/56* (2013.01); *H01H 47/02* (2013.01); *H01H 47/22* (2013.01); *H01H 47/223* (2013.01); *H01H 50/44* (2013.01); *H01H 50/24* (2013.01); *H01H 50/54* (2013.01); *H01H 51/2245* (2013.01); *H01H 51/2272* (2013.01); *H01H 2009/307* (2013.01); *H01H 2051/2218* (2013.01)

(58) Field of Classification Search

CPC ..... H01H 50/44; H01H 7/16; H01H 9/30; H01H 3/28; H01H 9/56; H01H 47/02; H01H 47/223; H01H 47/22; H01H 1/54; H01H 1/50; H01H 51/2272; H01H 2009/307; H01H 50/24; H01H 51/2245; H01H 2051/2218; H01H 50/54

USPC ..... 335/124, 125, 128

See application file for complete search history.

(56) References Cited

U.S. PATENT DOCUMENTS

| | | | | |
|---|---|---|---|---|
| 3,188,527 | A | 6/1965 | Luce | |
| 5,583,471 | A | 12/1996 | Weiser et al. | |
| 6,292,075 | B1 | 9/2001 | Connell et al. | |
| 6,661,319 | B2 * | 12/2003 | Schmelz | 335/78 |
| 7,501,920 | B2 * | 3/2009 | Yuba et al. | 335/78 |
| 8,203,403 | B2 * | 6/2012 | Moeller et al. | 335/78 |
| 8,330,564 | B2 * | 12/2012 | Miller | 335/78 |

FOREIGN PATENT DOCUMENTS

| | | |
|---|---|---|
| GB | 2249892 | 5/1992 |
| GB | 2299896 | 10/1996 |
| GB | 2374218 | 10/2002 |
| GB | 2418780 | 4/2006 |

* cited by examiner

*Primary Examiner* — Bernard Rojas

(74) *Attorney, Agent, or Firm* — Muncy, Geissler, Olds & Lowe, P.C.

(57) ABSTRACT

An electrical contactor has a first terminal having a fixed member with at least one fixed electrical contact, a second terminal, and a busbar connected to the second terminal. Two conductive movable arms are connected to the busbar and have a contact thereon. One arm is biased-closed to contact the fixed electrical contact in the absence of a separating force, and the other arm is biased-open to be spaced away from the fixed electrical contact in the absence of a closing force. The first and second movable arms and the busbar are arranged so that, when the contacts close, contra-flowing current urges the movable arms towards the fixed member to increase a force between the contacts.

20 Claims, 7 Drawing Sheets

ALTERNATING CURRENT SWITCH CONTACTOR

CROSS REFERENCE TO RELATED APPLICATIONS

This non-provisional patent application claims priority under 35 U.S.C. §119(a) from Patent Application No. GB1320859.0 filed in The United Kingdom on Nov. 26, 2013, the entire contents of which are hereby incorporated by reference.

FIELD OF THE INVENTION

The present invention relates to an electrical contactor, particularly but not necessarily exclusively for moderate AC switching contactors employed in modern electricity meters, so-called 'smart meters', for performing a load-disconnect function at normal domestic supply mains voltages, typically being 100 V AC to 250 V AC.

BACKGROUND OF THE INVENTION

The invention may also relate to an electrical contactor of a moderate, preferably alternating, current switch which may be subjected to a short-circuit fault condition requiring the contacts to not weld. In this welded-contact fault condition, un-metered electricity is supplied. This can lead to a life-threatening electrical shock hazard, if the load connection that is thought to be disconnected is still live at 230 V AC. Furthermore, the present invention relates to an electrical contactor and/or methods which reduce contact erosion, arcing and/or tack welding.

Furthermore, it is a requirement that the opening and closing timing of the electrical contacts in such a moderate-current switch should be more precisely controlled to reduce or prevent arcing damage thereby increasing their operational life.

The term 'moderate' is intended to mean less than or equal to 120 Amps.

It is known that many electrical contactors are capable of switching nominal current at, for example, 100 Amps, for a large number of switching load cycles. The switch contacts utilize a suitable silver-alloy which prevents tack-welding. The switch arm carrying the movable contact must be configured to be easily actuated for the disconnect function, with minimal self-heating at the nominal currents concerned.

Most meter specifications stipulate satisfactory nominal-current switching through the operational life of the device without the contacts welding. However, it is also required that, at moderate short-circuit fault conditions, the contacts must not weld and must open on the next actuator-driven pulse drive. At much higher related dead-short fault conditions, it is stipulated that the switch contacts may weld safely. In other words, the movable contact set must remain intact, and must not explode or emit any dangerous molten material during the dead-short duration, until protective fuses rupture or circuit breakers drop-out and disconnect the Live mains supply to the load. This short-circuit duration is usually for only one half-cycle of the mains supply, but in certain territories it is required that this short-circuit duration can be as long as four full cycles.

In Europe, and most other countries, the dominant meter-disconnect supply is single-phase 230 V AC at 100 Amps, and more recently 120 Amps, in compliance with the IEC 62055-31 specification. Technical safety aspects are also covered by other related specifications such as UL 508, ANSI C37.90.1, IEC 68-2-6, IEC 68-2-27, IEC 801.3.

There are many moderate-current meter-disconnect contactors known that purport to satisfy the IEC specification requirements, including withstanding short-circuit faults and nominal current through the operational life of the device. The limiting parameters may also relate to a particular country, wherein the AC supply may be single-phase with a nominal current in a range from 40 to 60 Amps at the low end, and up to 100 Amps or more recently to a maximum of 120 Amps. For these metering applications, the basic disconnect requirement is for a compact and robust electrical contactor which can be easily incorporated into a relevant meter housing.

In the context of the IEC 62055-31 specification, the situation is more complex. Meters are configured and designated for one of several Utilization Categories (UC) representing a level of robustness regarding the short-circuit fault-level withstand, as determined by certain tests carried out for acceptable qualification or approval. These fault-levels are independent of the nominal current rating of the meter.

An electrical switching device is known which utilizes a single movable arm having one movable electrical contact thereon movable into engagement with a fixed electrical contact. However, it is very difficult to balance contact-repulsion forces and movable arm forces at high current. Furthermore, being a single relatively stiff moving arm or blade, actuation presents quite a challenge with AC drives in a small housing.

The non-weld UC levels demanded are also very challenging, irrespective of whether the switch is closing into or carrying the short-circuit currents. In most cases, the very high current-density during a short-circuit condition at the single-contact touch-point can easily create tack-welds.

It is also known that, to reduce the heating effects of high current, the single movable arm may be split into two. However, this does not overcome the problem associated with simultaneous driving of the arms or blades to open and close together. This can lead to serious imbalances within the contact set and actuator, resulting in shock, vibration and contact bounce.

The present invention seeks to provide solutions to these problems.

SUMMARY OF THE INVENTION

According to a first aspect of the invention, there is provided an electrical contactor comprising a first terminal having a fixed member with at least one fixed electrical contact; a second terminal; a busbar in electrical communication with the second terminal; at least two electrically-conductive movable arms connected to the busbar and having a movable electrical contact thereon; a biased-closed said movable arm being preformed and preloaded to be biased towards the said at least one fixed electrical contact in the absence of a separating force; a biased-open said movable arm being preformed and preloaded to be biased away from the said at least one fixed electrical contact in the absence of a closing force; and the biased-closed and biased-open movable arms and the busbar being arranged so that, when the contacts close, contra-flowing current urges the movable arms towards the fixed member to increase a force between the contacts.

Preferably, the movable arms are cantilevered to the busbar. Furthermore, the ends of the movable arms and the busbar may be curved. To this end, the busbar and the movable arms may have matching or substantially matching profiles.

The movable arms may include flexible repulsive portions along at least part of their longitudinal extents, the flexible repulsive portions being urgable by a repulsive force between the movable arms and the busbar which urges the movable arms away from the busbar proximally of the movable electrical contacts. It is also beneficial that each movable arm is preferably arranged to carry at least substantially equal current.

Advantageously, the electrical contactor may further comprise an actuation arrangement for positively retaining at least the biased-closed movable arm in spaced relationship with the fixed electrical contact. In this case, the actuation arrangement, in a contacts-open condition, may positively bias the biased-closed movable arm away from the fixed electrical contact. Furthermore, the actuation arrangement, in a contacts-closed condition, may positively bias the biased-open movable arm towards the fixed member, so that the contacts close.

Preferably, a distal extension element is further included which extends from the biased-open movable arm distally of the movable contact. The distal extension element may be L-shaped, so as to be cantilevered from a distal end of the biased-open movable arm. Additionally or alternatively, a distal end of the distal extension element is preferably at or adjacent to a plane of an off-side edge of the biased-closed movable arm.

The actuation arrangement preferably includes a leaf-spring element for biasing the biased-open movable arm to close with the fixed contact. Beneficially, the actuation arrangement may include an AC dual-coil actuator, one said coil being arranged to open and close the electrical contacts and a second said coil being arranged to provide feedback, so that the opening and closing of the contacts is synchronized or substantially synchronized with the AC waveform zero-crossing. In this case, the AC dual-coil actuator may be a H-armature actuator.

Preferably, the electrical contactor further comprises an AC power supply for energizing the said first coil of the AC dual-coil actuator. The in use AC power supply may output, for example, half-cycle waveform drive pulses and/or quarter-cycle waveform drive pulses to the first drive coil, so as to reduce erosion energy applied between contacts and/or to prevent contact separation subsequent to peak load current.

A shape of the waveform of the drive pulse may be chosen to facilitate synchronization of the opening and closing of the contacts with the AC waveform zero-crossing. Even if full synchronization is not possible, in particular the opening of the contacts can be controlled to take into account a required separation force when magnetic latching is utilized, thereby positively shifting the opening point towards the AC waveform zero-crossing. Preferably, a positive half-cycle pulse for closing the contacts and a negative half-cycle pulse for opening the contacts may be used or vice versa. However, more preferably, a delayed positive quarter-cycle pulse and a delayed negative quarter-cycle pulse may be applied to close and open the contacts.

Preferably, each movable arm includes at least two electrically-conductive overlying layers, thereby reducing a flexure force. In this case, it may be advantageous that the overlying layers extend over at least a majority of a longitudinal extent of the movable arm, and are solely interconnected at or adjacent to their respective proximal and distal ends. Furthermore, three said electrically-conductive overlying layers are preferably provided interengaged at their respective proximal and distal ends.

According to a second aspect of the invention, there is provided a movable electrical contact set comprising an electrically-conductive busbar; at least two electrically-conductive movable arms connected to the busbar and having a movable electrical contact thereon; and at least one fixed electrical contact; a biased-closed said movable arm being preformed and preloaded to be biased towards the said at least one fixed electrical contact in the absence of a separating force; a biased-open said movable arm being preformed and preloaded to be biased away from the said at least one fixed electrical contact in the absence of a closing force; and the biased-closed and biased-open movable arms and the busbar being arranged so that, when the contacts close, contra-flowing current urges the movable arms away from the busbar to increase a force between the contacts.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
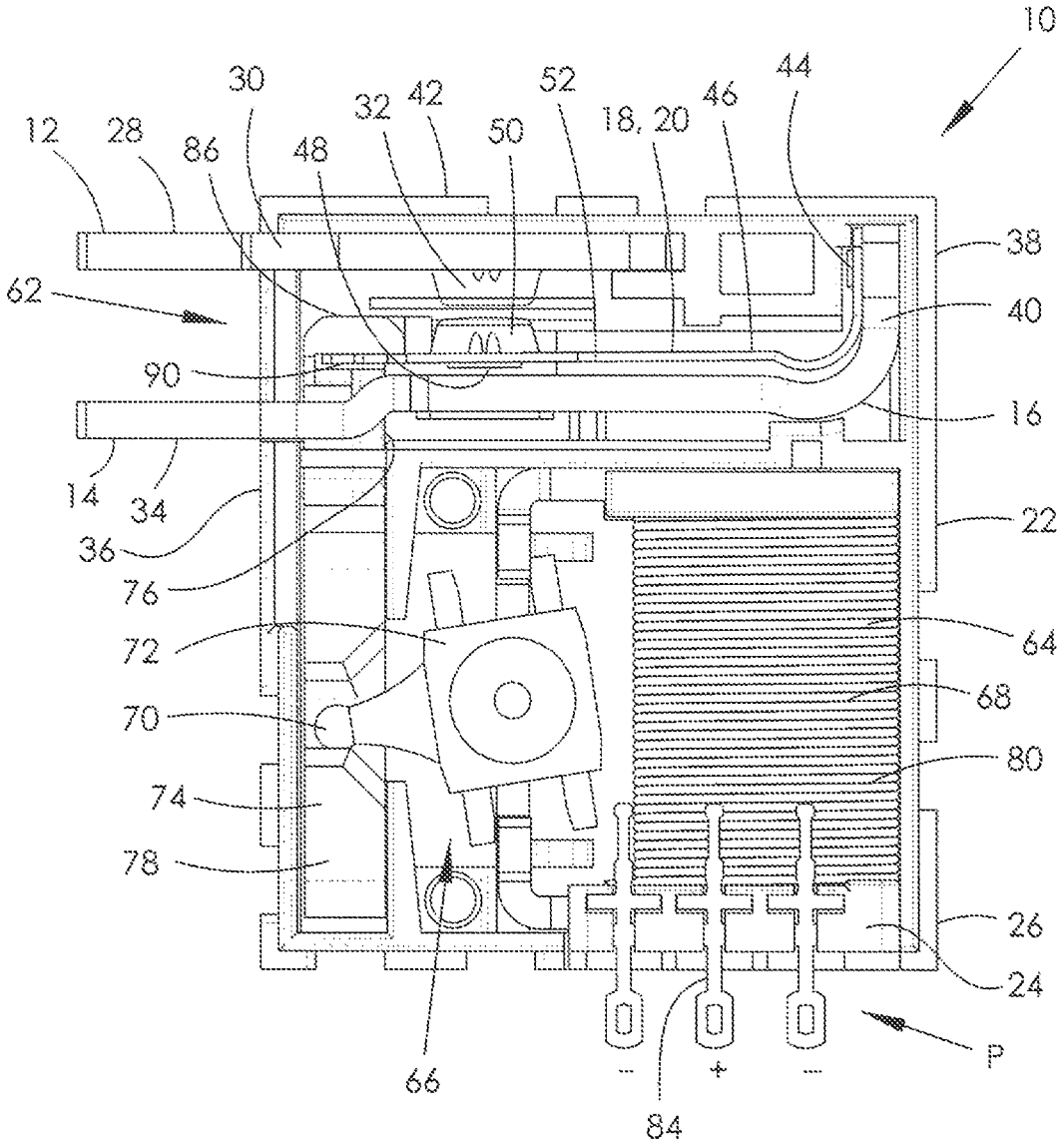
FIG. 1 is a diagrammatic plan view of a first embodiment of an electrical contactor, in accordance with the present invention and utilizing a movable electrical contact set in accordance with the second aspect of the invention, shown in a contacts-open condition.

Referring firstly to FIGS. 1 to 7 of the drawings, there is shown a first embodiment of an electrical contactor, globally shown at 10 and in this case being a single pole device, which comprises first and second terminals 12, 14, a busbar 16, and two movable arms 18, 20 mounted to the busbar 16.

The first and second terminals 12, 14 extend from a contactor housing 22, and are mounted to a housing base 24 and/or an upstanding perimeter wall 26 of the contactor housing 22. The housing cover is not shown for clarity.

The first terminal 12 includes a first terminal pad 28 and a fixed, preferably electrically-conductive, member 30 which extends from the first terminal pad 28 into the contactor housing 22. At least one, and in this case two, fixed electrical contacts 32 are provided at or adjacent to a distal end of the fixed member 30. Although two fixed electrical contacts 32 are provided which are spaced apart from each other, it is feasible that a single fixed electrical contact could be provided as a strip accommodating both movable arms 18, 20. However, this would likely increase an amount of contact material required, and thus may not be preferable.

The second terminal 14, which is spaced from the first terminal 12, includes a second terminal pad 34 which extends from the contactor housing 22 and which electrically communicates with the busbar 16.

The busbar 16 is a single rigid elongate monolithic electrically-conductive strip of material, typically being metal, which extends from the second terminal pad 34 at or adjacent one side wall 36 of the contactor housing 22 to an opposing side wall 38 of the contactor housing 22. To further increase a length which facilitates thermal stability in the movable arms 18, 20, the distal tail end portion 40 of the busbar 16 remote from the second terminal pad 34 may be curved to terminate at or adjacent a first end wall 42, along which the fixed member 30 preferably extends.

The two movable arms 18, 20 are engaged with the busbar 16 at or adjacent to its distal tail end portion 40. Engagement may take any suitable form, providing electrical communication is facilitated between the movable arms 18, 20 and the busbar 16. For example, welding, brazing, riveting or even bonding may be utilized.

With reference to FIGS. 1 and 3, the movable arms 18, 20 may comprise a proximal common tail portion 44 which presents a land for engagement with the busbar 16, and elongate body portions 46 which extend in parallel spaced relationship from the common tail portion 44. The movable arms 18, 20 each terminate with a head portion 48 at which is located a movable electrical contact 50.

The common tail portion 44 of the movable arms 18, 20 is curved towards the first end wall 42 of the contactor housing 22, in order to accommodate the curvature of the distal tail end portion 40 of the busbar 16. The curvature may extend partly to the body portions 46 of the movable arms 18, 20. However, at least a majority of a longitudinal extent of each body portion 46 is preferably straight or rectilinear. Furthermore, it is preferable that the two movable arms 18, 20 are coplanar or substantially coplanar, so that a common or uniform predetermined gap is provided between the movable arms 18, 20 and the busbar 16 as well as between the movable electrical contacts 50 and the fixed electrical contacts 32 in a contacts-open condition.

The elongate body portion 46 of each movable arm 18, 20 defines a repulsive flexible portion 52 between the common tail portion 44 and the head portion 48. The repulsive flexible portion 52 of each movable arm 18, 20 lies in close proximity with a planar body portion 54 of the busbar 16, and may arcuately extend to follow the arcuate distal tail end portion 40.

Although in some instances the movable arms 18, 20 may not necessarily be formed of electrically conductive material, such as copper for example, whereby the movable electrical contacts 50 are fed by or feed separate electrical conductors, such as a wire or cable, in this embodiment it is required that a repulsive force be generatable between the opposing busbar 16 and movable arms 18, 20, and therefore it is preferred that the movable arms 18, 20 are electrically conductive.

It is important that the contacts used have adequate top-lay silver-alloy thickness in order to withstand the arduous switching and carrying duties involved, thus reducing contact wear. Prior art electrical contacts of an 8 mm diameter bi-metal have a silver-alloy top-lay thickness in a range 0.65 mm to 1.0 mm. This results in a considerable silver cost.

To address the issue of tack welding between contacts under high short-circuit loads, a particular compound top-lay can be utilized, in this case enriching the silver alloy matrix with a tungsten-oxide additive. Addition of the tungsten-oxide additive in the top-lay matrix has a number of important effects and advantages, amongst which are that it creates a more homogeneous top-lay structure, puddling the eroding surface more evenly, but not creating as many silver-rich areas, thus limiting or preventing tack-welding. The tungsten-oxide additive raises the general melt-pool temperature at the switching point, which again discourages tack-welding, and due to the tungsten-oxide additive being a reasonable proportion of the total top-lay mass, for a given thickness, its use provides a cost saving.

To assist in damping an opening and closing process of the movable and fixed electrical contacts 32, one of the two movable arms 18, 20 is preformed and preloaded to be naturally biased towards its fixed electrical contact 32, whereas the other of the two movable arms 18, 20 is preformed and preloaded to be naturally biased away from its fixed electrical contact 32.

The biased-closed movable arm 58 is therefore configured to normally or naturally close, for example, with a contact force of 100 gF to 150 gF.

Preferably, the biased-open movable arm 60 must therefore be driven closed, and in this case preferably with an over-travel force of 200 gF to 250 gF.

To control the movable electrical contact set, described above and globally referenced as 62, an actuator arrangement 64 is utilized which comprises in this case an AC driven H-armature rotary motor 66 having a dual-coil unit 68. A drive arm 70 of the rotor 72 of the motor 66 controls a slider unit 74 having a linearly-slidable plunger 76 axially displaceable by the drive arm 70 within a slider housing 78.

Figure 5:
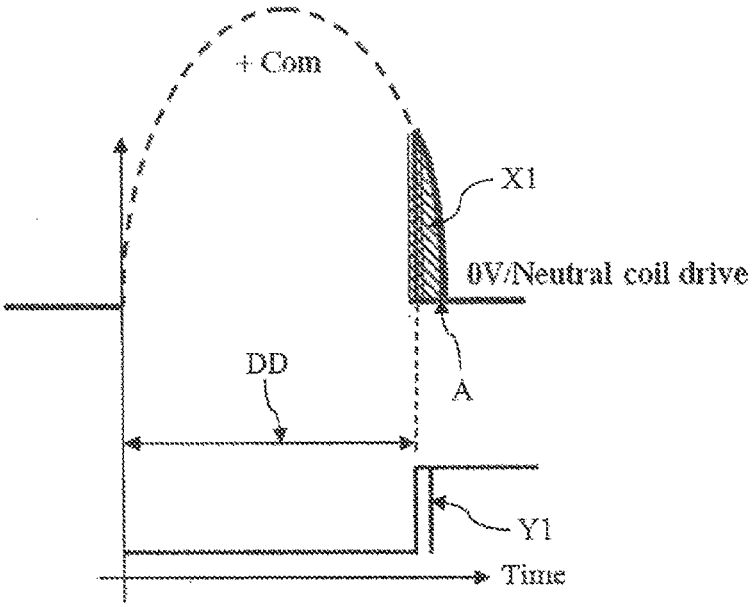
FIG. 5 graphically represents the additional control over the closing of the contacts provided by the electrical contactor.
Figure 7:
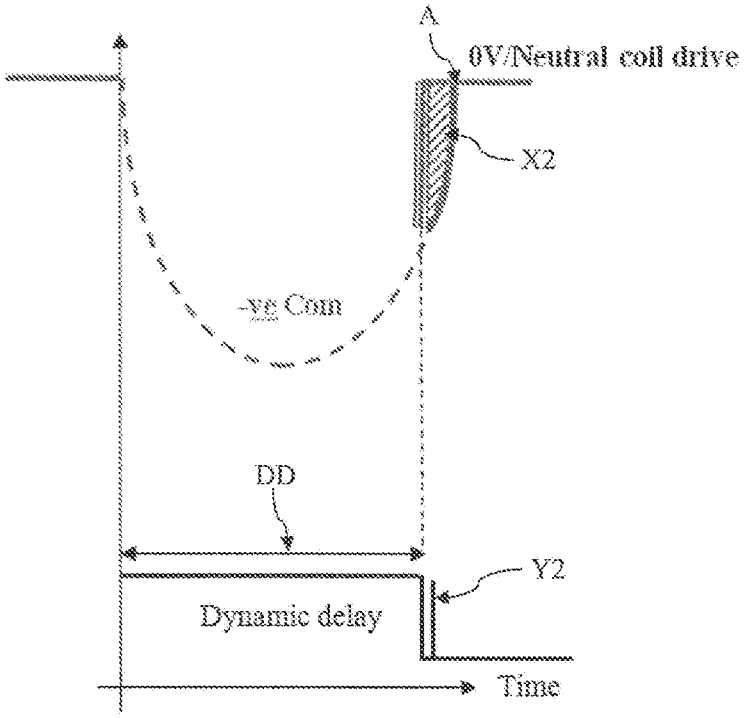
FIG. 7, similarly to FIG. 5, graphically represents the additional control over the opening of the contacts provided by the electrical contactor.

In this embodiment, to improve a balance of the opening (release) and closing (operate) processes of the movable and fixed electrical contacts 50, 32, as well as reducing the deleterious effects of arcing and contact bounce, the AC coil drive is synchronized or more closely aligned with an AC load waveform zero-crossing point, referenced as A in FIGS. 5 and 7.

To this end, the actuator arrangement 64 is adapted so that only one coil 80 of the dual-coil unit 68 may be AC pulse driven in one polarity to advance the plunger 76, and then AC pulse driven with a reversed polarity to withdraw the plunger 76.

The non-driven or non-energized coil 82 of the dual-coil unit 68 is feedback connected to the original AC+common center connection 84 of the dual-coil unit 68.

To thereby allow control of the biased-closed and biased-open movable arms 58, 60, the plunger 76 of the slider unit 74 includes an engagement element 86 and carries an urging device 88. The engagement element 86 in this case may be an overhanging platform which abuts a proximal end portion of the biased-closed movable arm 58, preferably spaced from the associated movable electrical contact 50.

Figure 3A:
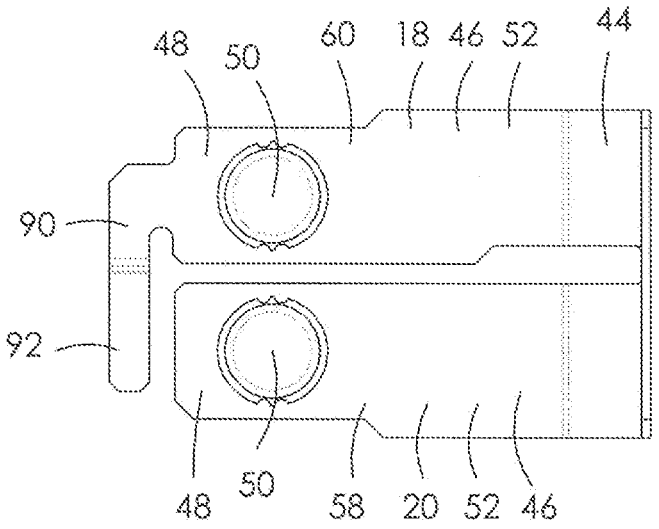
FIG. 3*a* is a plan view of two movable arms of the contact set of the electrical contactor, shown in FIG. 1.
Figure 3B:
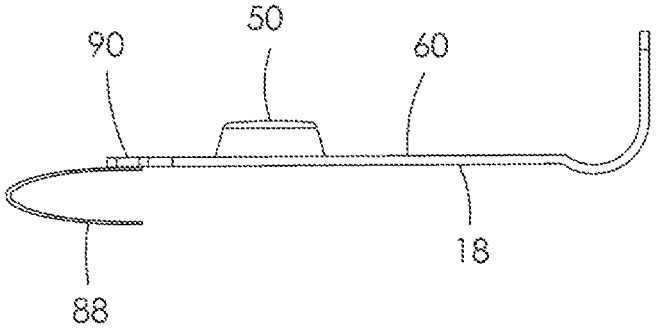
FIG. 3*b* is a side view of a biased-open movable arm shown in FIG. 3*a*, along with a leaf spring forming an urging device.

The urging device 88 may be a leaf spring, as shown in FIG. 3*b*. To therefore facilitate engagement of the leaf spring 88 with the biased-open movable arm 60, a distal extension element 90, which may be in the form of a tang or tongue, extends from the head portion 48 of the biased-open movable arm 60, proximally of the associated movable electrical contact 50 and towards the slider unit 74. As can be seen in FIG. 3*a*, it is preferable that the distal extension element 90 is an elongate L-shaped member having a free distal end 92 which is at or approaching a plane of the off-side longitudinal edge of the biased-closed movable arm 58.

The leaf spring 88 is mounted on the slider unit 74 or contactor housing 22 so that, when the plunger 76 is advanced, the leaf spring 88 urges the biased-open movable arm 60 towards its respective fixed electrical contact 32 with the aforementioned over-travel force.

The urging device may take other alternative forms, such as a secondary platform carried by the plunger 76 which is engagable with an underside of the distal extension element 90 to force the biased-open movable arm 60 into contact with its fixed electrical contact 32, or as a coil spring.

It is feasible that the distal extension element 90 may be dispensed with, if the head portion 48 of the biased-open movable arm 60 can be engaged or controlled in a similar manner to the biased-closed movable arm 58.

To reduce energy consumption associated with the actuator arrangement 64, the plunger 76 may be adapted to magnetically latch in its advanced and withdrawn states.

Figure 2:
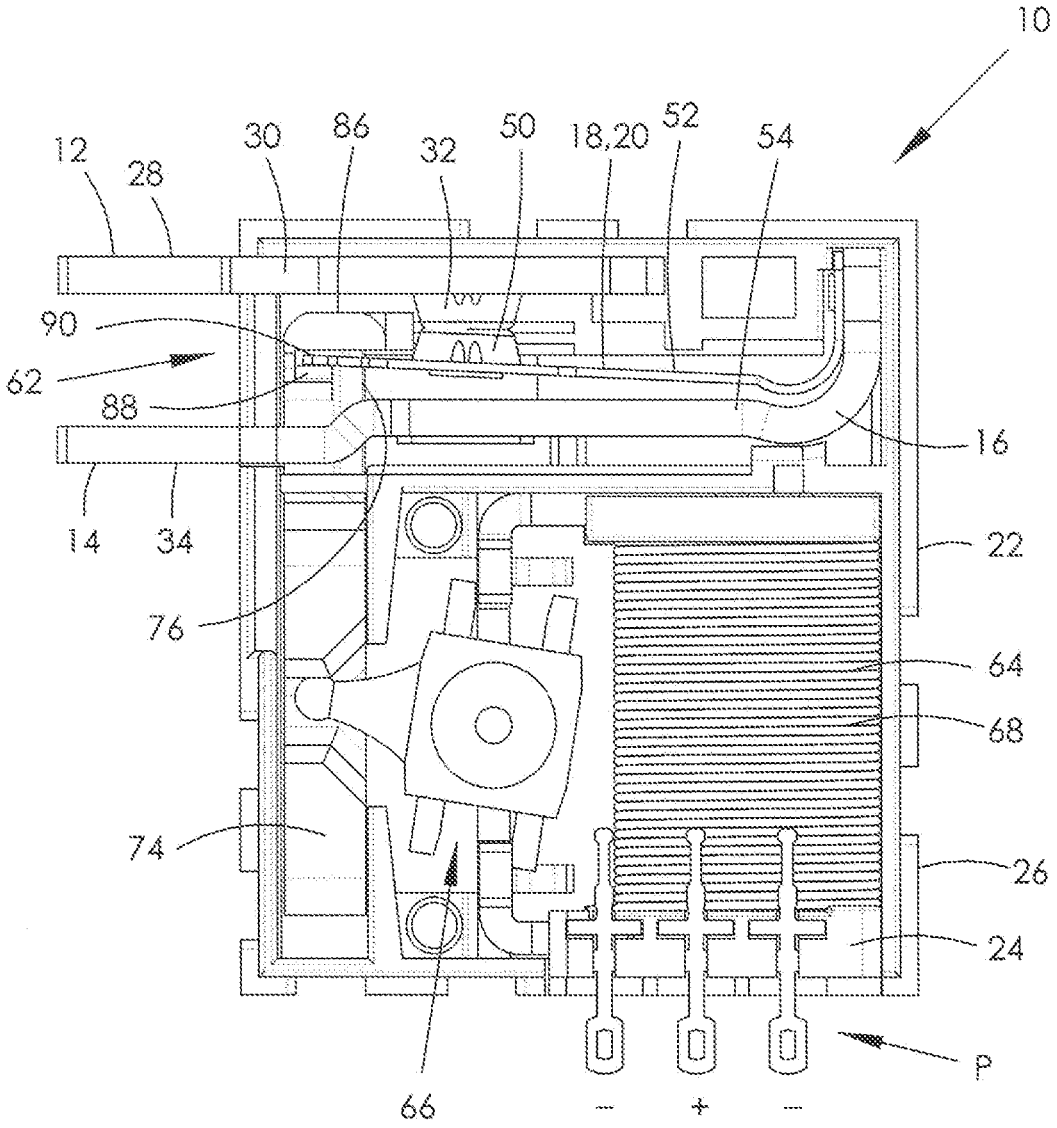
FIG. 2 is a view similar to FIG. 1 of the electrical contactor, shown in a contacts-closed condition.
Figure 4:
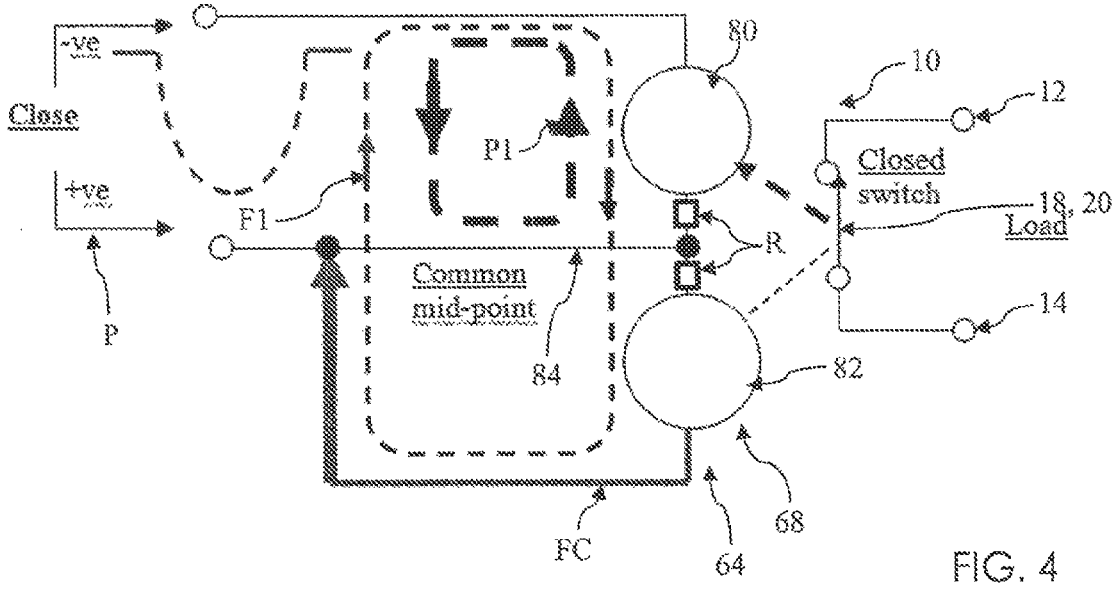
FIG. 4 is a generalized circuit diagram of the electrical contactor, showing an actuator with feedback connection being driven to close the contacts.

In operation, the H-armature rotary motor 66 of the actuator arrangement 64 is driven to advance the plunger 76 to its first contacts-closed magnetically-latched state, as shown in FIG. 2. As mentioned above, by energizing only the drive coil 80 of the dual-coil unit 68 with a first polarity P1 and with the non-driven coil 82 feedback connected, as shown in FIG. 4, a reverse flux, F1, can be induced via the feedback connection FC in the non-driven coil 82 thereby tempering and feedback stabilizing a net flux in the AC dual-coil unit 68. This allows the contact closing time DD to be controlled and therefore shifted to or adjacent to the AC load waveform zero-crossing point A, as shown in FIG. 5.

As a consequence, and as can be understood from FIG. 5, by carefully matching the coils, the strength of the feedback connection, and therefore the controlled delay of the closing of the movable and fixed electrical contacts 50, 32, arcing and thus contact erosion energy is reduced or eliminated, shown by hatched portion X1 in FIG. 5, prolonging contact life or improving endurance life. Possible contact bounce, referenced at Y1, is also shifted to or much closer to the zero-crossing point, referenced at A, again improving contact longevity and robustness during closing.

In the contacts-closed condition, as can be appreciated from FIG. 2, the biased-closed movable arm 58, in the absence of a separating force, naturally closes with its fixed electrical contact 32 with its preloaded biasing force. The biased-open movable arm 60, with the advancement of the plunger 76, is closed via the leaf spring 88 urging the flexible distal extension element 90.

With the movable arms 18, 20 extending substantially in parallel with the busbar 16, the contra-flowing current produces a repulsive force between the movable arms 18, 20 and the busbar 16 proximally of the movable contacts 50 at the repulsive flexible portions 52. This causes upward bowing of the movable arms 18, 20 away from the busbar 16, thereby augmenting and thus enhancing a closure force at the closed contacts.

At a high shared short-circuit fault current, a significant repulsive magnetic force is generated at the flexible portions 52, causing greater upward bowing and therefore a much higher contact closing force. This repulsive force, due to the flex of the movable arms 18, 20, also potentially causes the movable contacts 50 to tilt relative to the fixed contacts 32, resulting in contact wiping which may be further beneficial in preventing or limiting tack-welding With the H-armature rotary motor 66 being driven to withdraw the plunger 76 to its second contacts-open magnetically-latched state, the engagement element 86, being the overhanging platform in this embodiment, picks up the biased flexible distal extension element 90 of the biased-open movable arm 60. By the engagement element 86 counteracting the biasing closed force of the urging device 88, the biased-open movable arm 60 tends to snap open. Simultaneously or fractionally later, the engagement element 86 collects the biased-closed movable arm 58 as the plunger 76 withdraws, positively breaking the contact engagement between the movable electrical contact 50 of the biased-closed movable arm 58 and its fixed electrical contact 32.

Figure 6:
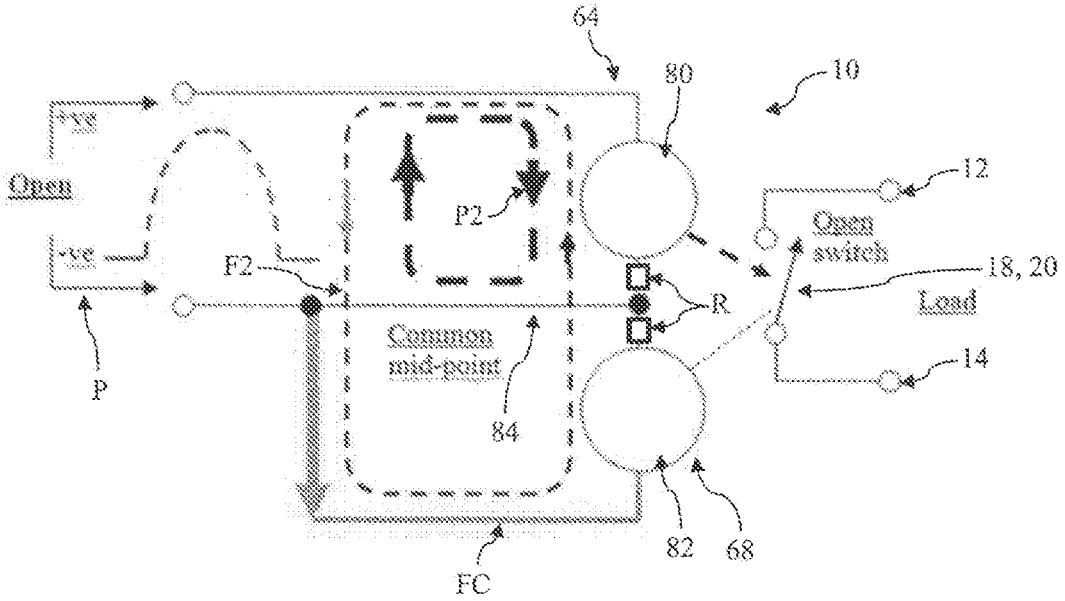
FIG. 6 is a generalized circuit diagram of the electrical contactor, similar to that of FIG. 4 and showing the actuator with feedback connection being driven to open the contacts.

As with the closing or operating process, by reverse driving only the drive coil 80 of the dual-coil unit 68 with a reverse polarity P2 and with the non-driven coil 82 feedback connected, as shown in FIG. 6, a reverse flux F2 can be induced via the feedback connection FC in the non-driven coil 82 thereby tempering and feedback stabilizing a net flux in the AC dual-coil unit 68. This allows the contact opening time DD to be controlled and therefore shifted to or adjacent to the AC load waveform zero-crossing point A, as shown in FIG. 7.

Therefore, again and as can be understood from FIG. 7, by carefully matching the coils, the strength of the feedback connection, and therefore the controlled delay of the opening of the movable and fixed electrical contacts 50, 32, arcing and thus contact erosion energy is reduced or eliminated, shown by hatched portion X2 in FIG. 7, prolonging contact life or improving endurance life. Possible contact bounce, referenced at Y2, is also shifted to or much closer to the zero-crossing point A, again improving contact longevity and robustness during opening.

By way of example, a standard or traditional contact opening and closing time may include a dynamic delay of 5 to 6 milliseconds, primarily due to the time taken to delatch the magnetically-retained plunger 76. By using the control of the present invention, this dynamic delay is fractionally extended to 7 to 8 milliseconds to coincide more closely or synchronize with the next or subsequent zero-crossing point of the AC load waveform.

Typically, the drive pulse applied to the drive coil 80 will have a positive half-cycle waveform to close the contacts 50, 32, and a negative half-cycle waveform to open the contacts 50, 32. Synchronization or substantial synchronization of the dynamic delay DD with the zero-crossing point A will reduce arcing and contact erosion energy.

If the contactor 10 is used over a wide range of supply voltages, the dynamic delay DD can vary greatly between the different voltages. The higher the supply voltage, the more rapid the actuation of the plunger 76. As a result, with a half-cycle drive pulse, there is a possibility of a very short dynamic delay DD, which may lead to contact closure occurring at or before the peak load current.

Figure 8:
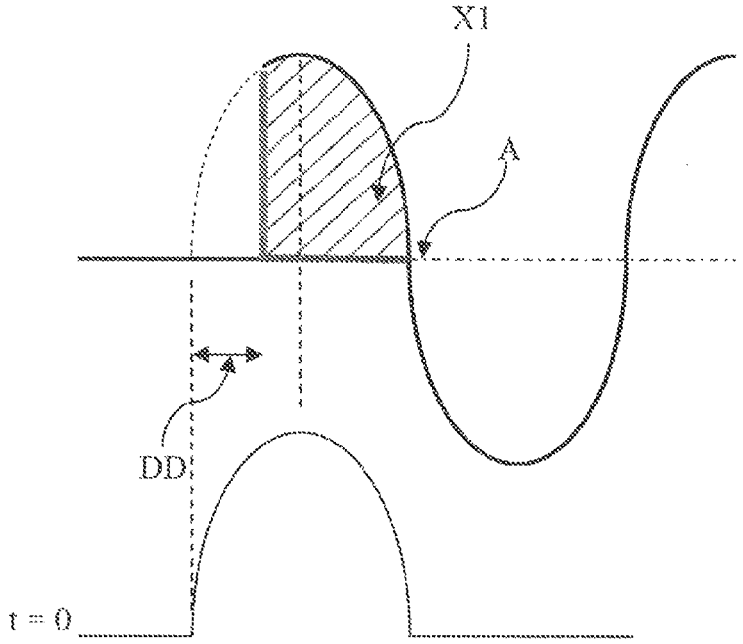
FIG. 8 graphically represents the additional control over preferably the closing of the contacts as driven by a half-cycle drive pulse.
Figure 9:
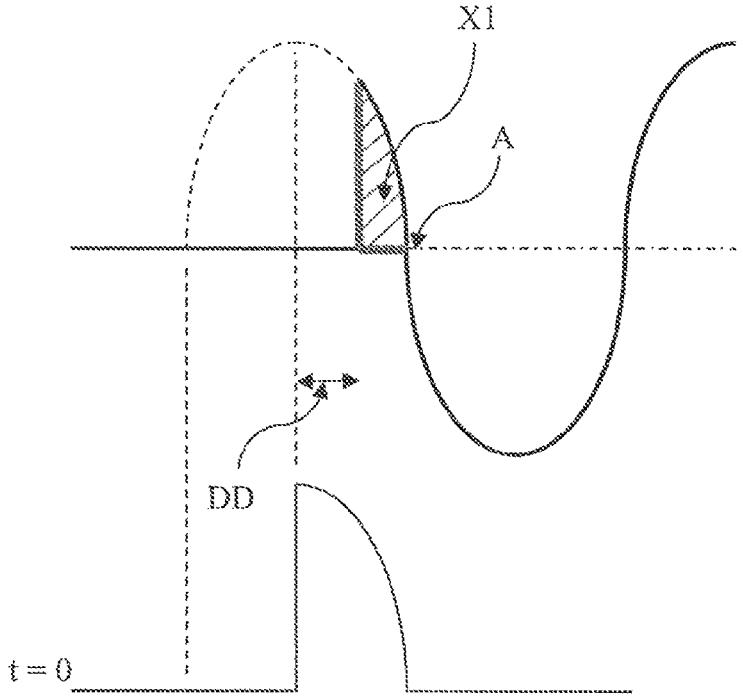
FIG. 9, similarly to FIG. 8, graphically represents the additional control over preferably the closing of the contact as driven by a quarter-cycle drive pulse.

As shown in FIG. 8, the dynamic delay DD is short due to a high or higher AC supply voltage. The subsequent contact erosion energy X1 is thus very large. This large contact erosion energy X1 may damage the contacts 50, 32, lessening their lifespans.

The contact erosion energy X1 can be further reduced by using an AC supply which energizes the drive coil 80 with a truncated drive pulse, in this case preferably being a quarter-cycle drive pulse, in place of the half-cycle drive pulse. In this arrangement, the quarter-cycle drive pulse will not trigger and thus drive the drive coil 80 until the peak load current is reached. As such, this can be considered a 'delayed' driving approach. As will be appreciated, the use of a truncated-waveform drive pulse may be utilized with or without the non-driven or non-energized coil 82 of the dual-coil unit 68 being feedback connected to the original AC+common center connection 84 of the dual-coil unit 68. As such, the use of a truncated-waveform drive pulse which preferably coincides with the peak load current may be utilized with any electrical actuator, for example, a single coil or a dual-coil actuator, in order to better control contact bounce, arc duration, and/or opening and closing delay or electrical contacts.

By triggering the truncated-cycle, being in this case a quarter-cycle, drive pulse on the peak load current, the closing of the contacts 50, 32 can never occur prior to the peak load current. However, by utilizing a control circuit as part of the power supply P outputting to the electrical actuator, a degree of truncation of the current waveform on the time axis can be carefully selected and optimized based on the peak load current, the required contact opening and closing force and delay, and the arc and/or erosion energy imparted to the contacts during the contact opening and closing procedures. As such, although a quarter-cycle drive pulse is preferred, since this coincides with the peak load current, it may be beneficial for a controller outputting an energisation current to the actuator to be set to truncate the waveform of the drive pulse to be prior or subsequent to the peak load current.

The truncated-waveform drive pulse may be AC or DC.

The dynamic delay DD is still preferably configured to synchronize or substantially synchronize with the zero-crossing point A, thereby minimizing the contact erosion energy X1 even further. However, when utilized together with the controlled truncated waveform of the drive pulse, this is achieved in a more controlled manner than with the half-cycle drive pulse.

Figure 10:
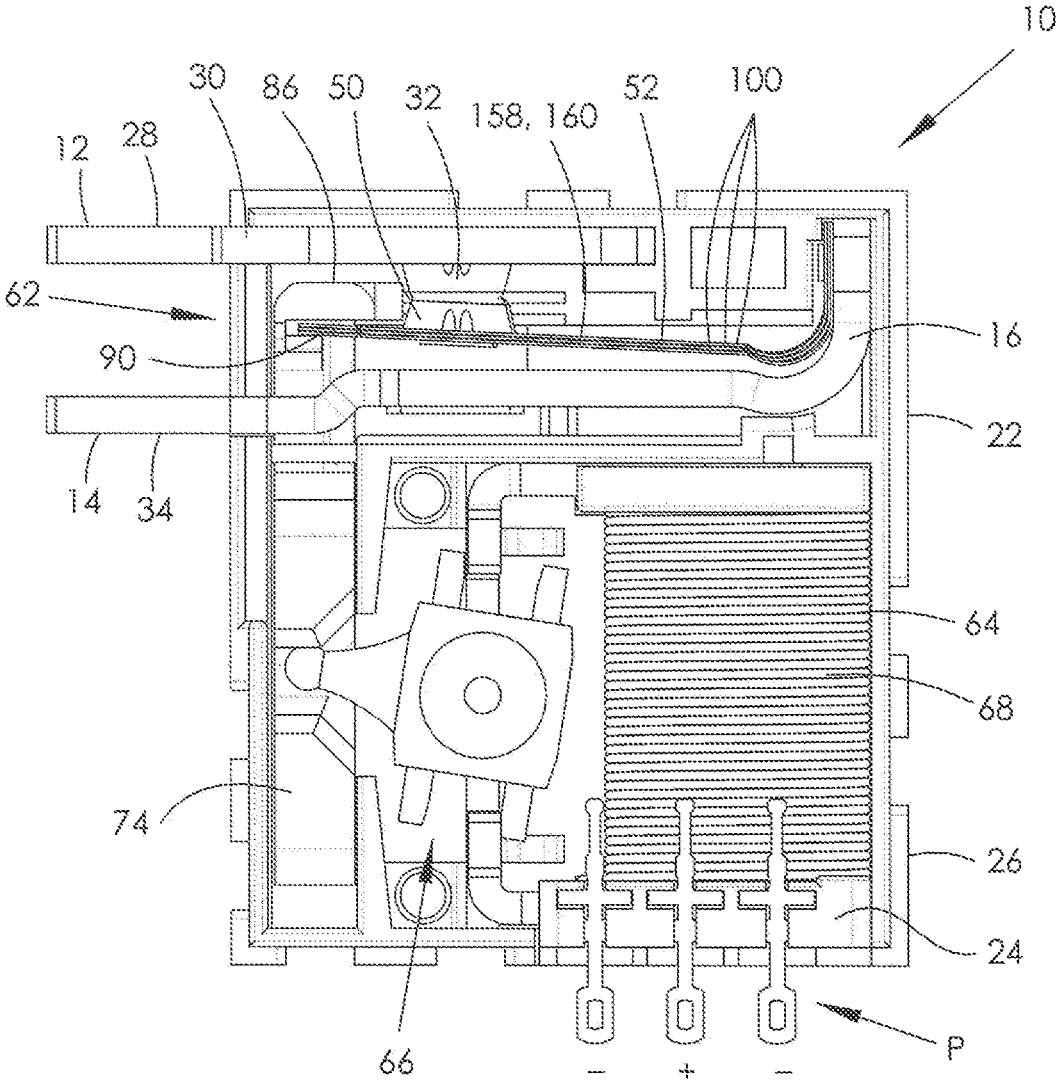
FIG. 10 is a diagrammatic plan view of a second embodiment of an electrical contactor, in accordance with the present invention and utilizing a movable electrical contact set in accordance with the second aspect of the invention, shown in a contacts-closed condition.

Referring to FIG. 10, a second embodiment of an electrical contactor 10 is shown. Similar or identical references refer to parts which are similar or identical to those described above, and therefore further detailed description is omitted.

In this case, the electrical contactor 10 again comprises a movable electrical contact set 62 which includes the busbar 16, biased-open and biased-closed movable arms 158, 160 connected to the busbar 16 and having movable electrical contacts 50 thereon, and the associated fixed electrical contact 32. The movable electrical contact set 62 is provided in the contactor housing 22, with the associated first and second terminals 12, 14 as required.

The American National Standards Institute (ANSI) requirements are particularly demanding for nominal currents up to 120 Amps. The short-circuit current is 10 K.Amp rms, but for a longer withstand duration of four full Load cycles, with 'safe' welding allowable.

The single-thickness push-pull multiple arms or blades 18, 20 of the first embodiment are sufficient such that, during a short-circuit load condition of only half-cycle duration, thermal parameters of the shared split movable contact arms 18, 20 are adequate, thereby showing no excessive heating and not losing spring characteristics.

The ANSI short-circuit withstand duration is four full Load cycles, thereby being eight times longer than that of the IEC requirement at only half-cycle. The extra $I^2R$ heat generated has to be accommodated to ensure that the thermal parameters are adequate with no excessive heating or lose of spring characteristic, whilst still being drivable by the actuator arrangement 64.

Each movable arm 158, 160 therefore includes at least two electrically-conductive overlying layers 100, thereby effectively forming a laminated movable arm. In this embodiment, three overlying layers 100 are provided, but more than three layers can be envisaged. The layers 100 are preferably of the same electrically-conductive material, typically being metal, such as copper, but may be of different electrically-conductive materials.

At least one, and preferably all, of the superposed layers 100 are preferably thinner than the single layer movable arms 18, 20 of the first embodiment. Consequently, whilst the overall thickness of the laminated movable arm 158, 160 of the second embodiment may be greater than the thickness of the unlaminated movable arm 18, 20 of the first embodiment, thereby accommodating a greater heating effect, a flexure force can be decreased. In general terms, a double lamination will halve a flexure force, and a triple lamination will reduce the flexure force by around two thirds.

Longitudinal and lateral extents of the groups of overlying layers 100 are preferably matched or substantially matched. The layers 100 extend from their common tail portions 44 at which they are interconnected, for example, by riveting, brazing or welding, to the head portions 48. Advantageously, the respective movable electrical contacts 50 may interengage the respective head portions 48 of the associated overlying layers 100.

It is beneficial for heat dissipation that the overlying layers 100 may not be further interconnected along their longitudinal extents. However, additional interconnection such as by riveting can be accommodated, if required.

The above embodiments benefit from the actuator arrangement 64 which utilizes only one AC drive coil 80 energized in two polarities to advance and withdraw the plunger 76 along with the feedback connected non-driven coil 82. However, benefits can still be obtained by utilizing the AC dual-coil unit 68 in which one coil is, preferably negatively, AC driven to advance the plunger 76 whilst the other coil is, preferably negatively, AC driven to retract the plunger 76. In this regard, the AC dual-coil unit 68 is driven via a series resistor R to the positive common midpoint.

Although the above embodiments are described with respect to a split movable contact arm, thereby presenting twin parallel arms or blades, the actuator arrangement which utilizes only one AC drive coil driven in two polarities to advance and withdraw the plunger along with the feedback connected non-driven coil to control a dynamic delay of the opening and closing contacts can be applied to a single monolithic movable contact arm or single laminated movable contact arm with a plurality of layers as described above.

Furthermore, although a split movable contact arm having a single biased-closed movable arm and a single biased-open movable arm is suggested, more than one biased-closed movable arm and more than on biased-open movable arm may be provided. Equally, although balancing and heating may be an issue, it may be feasible to apply one or more of the principles described above with the use of only one movable contact and one fixed contact, with or without the busbar and with or without the dual-coil actuator. If the busbar is dispensed with, then it is preferable that the or each movable arm is in either direct or indirect electrical communication with the second terminal.

Additionally or alternatively, although the actuator arrangement described above is preferably a H-armature rotary motor, any other suitable actuator means can be utilized. For example, a double-magnet-latching electromagnetic actuator, preferably with dual coils for feedback optimized contact control, could certainly be utilized.

It is thus possible to provide an electrical contactor which utilizes a biased-closed movable contact arm and a biased-open movable contact arm to balance and reduce a drive burden of an actuator. A more balanced and efficient 'push-pull' multi-blade device is thus provided with a 'snatch-assisted' open translation. The AC dual-coil unit can also be minimized in terms of wire, typically copper, turns and thus cost.

It is also possible to reduce self-heating due to the multiple arms or blades. For example, at 100 Amps, with a twin arm or blade device, each arm or blade will be carrying 50 Amps. By utilizing laminations, this heating effect is still further mitigated. Contact welding at the higher moderate and dead-short fault currents is therefore prevented.

By use of the fixed busbar, the switching currents flow in the same direction in the side-by-side movable arms, thus maximizing a magnetic repulsion force between the arms across the working gap to the adjacent busbar carrying the contra-flowing total load current. Especially at very high current, the contacts are thus maintained tightly closed using this so-called blow-on technique. However, the busbar may not be an essential requirement in certain arrangements.

Since the load side contact-switching, connect-ON and disconnect-OFF functions may take place in the context of, for example, a 230 V AC supply at nominal current of 100 Amps, if the AC 0V/Neutral coil drive is not synchronized with the load AC waveform, the contact closing and opening points will be somewhat random, and may occur often before or at the voltage peak. This can cause considerably longer arcing, more contact erosion damage, and reduced endurance life. To mitigate this problem, it is thus also possible to provide an electrical contactor with an AC dual-coil drive which utilizes only one AC drive coil driven in two polarities to close and open the electrical contacts along with a feedback connected non-driven coil controlling a dynamic delay of the opening and closing contacts. By then further controlling an AC power supply to impart truncated or partial waveform drive pulses, preferably being half-cycle and more preferably being quarter-cycle, to the or each drive coil, it is possible to have a more complete delayed drive of the contact separation. It may also be feasible to have additional or alternative truncated or partial waveform drive profiles, and not just half- or quarter-cycle, thereby optimizing contact opening speed against potential erosion energy and arcing. By the use of an AC dual-coil actuator utilizing one coil as a drive coil and the other coil as a feedback coil, it is possible to more optimally control a dynamic delay of the opening of the contacts in particular. This control may be further optimized by the control of the AC waveform profile of the applied drive pulses. The principles of the feedback coil and/or the partial waveform drive pulses may be applied to any AC or DC energized electrical contactor, and not just the 'blow-on/blow-off' contactor arrangement described above.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. An electrical contactor comprising:

a first terminal having a fixed member with at least one fixed electrical contact;

a second terminal;

a busbar in electrical communication with the second terminal;

at least two electrically-conductive movable arms connected to the busbar and having a movable electrical contact thereon;

a biased-closed movable arm of at least two electrically-conductive movable arms being preformed and preloaded to be biased towards with the said at least one fixed electrical contact in the absence of a separating force; and a biased-open movable arm of at least two electrically-conductive movable arms being preformed and preloaded to be biased away from the said at least one fixed electrical contact in the absence of a closing force, wherein the biased-closed and biased-open movable arms and the busbar being arranged so that, when the contacts close, contra-flowing current urges the movable arms towards the fixed member to increase a force between the contacts.

2. The contactor of claim 1, wherein ends of the movable arms and the busbar are curved to a same direction.

3. The contactor of claim 1, wherein the busbar and the movable arms have matching or substantially matching profiles.

4. The contactor of claim 1, wherein the movable arms include flexible repulsive portions along at least part of their longitudinal extents, the flexible repulsive portions being urgable by a repulsive force between the movable arms and the busbar which urges the movable arms away from the busbar proximally of the movable electrical contacts.

5. The contactor of claim 1, wherein each movable arm is arranged to carry at least substantially equal current.

6. The contactor of claim 1, further comprising an actuator arrangement for positively retaining at least the biased-closed movable arm in spaced-relationship with the fixed electrical contact.

7. The contactor of claim 1, wherein the actuator arrangement, in a contacts-open condition, positively biases the biased-closed movable arm away from the fixed electrical contact.

8. The contactor of claim 7, wherein the actuator arrangement, in a contacts-closed condition, positively biases the biased-open movable arm towards the fixed member, so that the contacts close.

9. The contactor of claim 7, further comprising a distal extension element which extends from the biased-open movable arm distally of the movable contact.

10. The contactor of claim 9, wherein the distal extension element is L-shaped, so as to be cantilevered from a distal end of the biased-open movable arm.

11. The contactor of claim 10, wherein a distal end of the distal extension element is at or adjacent to a plane of an off-side edge of the biased-closed movable arm.

12. The contactor of claim 6, wherein the actuation arrangement includes a leaf-spring element for biasing the biased-open movable arm to close with the fixed contact.

13. The contactor of claim 7, wherein the actuator arrangement includes an AC dual-coil actuator, one said coil being arranged to open and close the electrical contacts and a second said coil being arranged to provide feedback, and the second said coil being directly feedback connected to an AC common center of the AC dual-coil actuator to induce a reverse flux; so that the opening and closing of the contacts is synchronized or substantially synchronized with the AC waveform zero-crossing.

14. The contactor of claim 13, wherein the AC dual-coil actuator is an H-armature actuator.

15. The contactor of claim 14, further comprising an AC power supply for energizing the said first coil of the AC dual-coil actuator, the in use AC power supply outputting half-cycle waveform drive pulses to the first drive coil, so as to reduce erosion energy applied between contacts.

16. The contactor of claim 14, further comprising an AC power supply for energizing the said first coil of the AC dual-coil actuator, the in use AC power supply outputting quarter-cycle waveform drive pulses to the first drive coil, so as to prevent contact separation prior to peak load current.

17. The contactor of claim 1, wherein each movable arm includes at least two electrically-conductive overlying layers, thereby reducing a flexure force.

18. The contactor of claim 17, wherein the overlying layers extend over at least a majority of a longitudinal extent of the movable arm, and are solely interconnected at or adjacent to their respective proximal and distal ends.

19. The contactor of claim 18, wherein three said electrically-conductive overlying layers are provided interengaged at their respective proximal and distal ends.

20. A movable electrical contact set comprising an electrically-conductive busbar; at least two electrically-conductive movable arms connected to the busbar and having a movable electrical contact thereon; and at least one fixed electrical contact; a biased-closed movable arm of at least two electrically-conductive movable arms being preformed and preloaded to be biased towards the said at least one fixed electrical contact in the absence of a separating force; a biased-open movable arm of at least two electrically-conductive movable arms being preformed and preloaded to be biased away from the said at least one fixed electrical contact in the absence of a closing force; and the biased-closed and biased-open movable arms and the busbar being arranged so that, when the contacts close, contra-flowing current urges the movable arms away from the busbar to increase a force between the contacts.

* * * * *